US011518965B2

(12) United States Patent
Hartmann et al.

(10) Patent No.: US 11,518,965 B2
(45) Date of Patent: Dec. 6, 2022

(54) POWDER AND GRANULE, PROCESS FOR MAKING SUCH POWDER AND GRANULE, AND USE THEREOF

(71) Applicant: BASF SE, Ludwigshafen (DE)

(72) Inventors: Markus Hartmann, Neustadt (DE); Marta Reinoso Garcia, Dossenheim (DE); Michael Klemens Mueller, Hassloch (DE); Roland Boehn, Maxdorf (DE); Markus Christian Biel, Mannheim (DE)

(73) Assignee: BASF SE, Ludwigshafen (DE)

( * ) Notice: Subject to any disclaimer, the term of this patent is extended or adjusted under 35 U.S.C. 154(b) by 66 days.

(21) Appl. No.: 16/857,791

(22) Filed: Apr. 24, 2020

(65) Prior Publication Data

US 2020/0248107 A1 Aug. 6, 2020

Related U.S. Application Data

(62) Division of application No. 15/118,808, filed as application No. PCT/EP2015/052533 on Feb. 6, 2015, now abandoned.

(30) Foreign Application Priority Data

Feb. 13, 2014 (EP) ..... 14154957
Oct. 20, 2014 (EP) ..... 14189501

(51) Int. Cl.

| | |
|---|---|
| ***C11D 3/33*** | (2006.01) |
| ***C11D 3/37*** | (2006.01) |
| ***C11D 3/39*** | (2006.01) |
| ***C11D 11/02*** | (2006.01) |
| ***C11D 17/06*** | (2006.01) |

(52) U.S. Cl.
CPC ..... *C11D 3/3942* (2013.01); *C11D 3/33* (2013.01); *C11D 3/3761* (2013.01); *C11D 11/02* (2013.01); *C11D 17/06* (2013.01)

(58) Field of Classification Search
CPC ..... C11D 3/33; C11D 3/3761; C11D 17/06
USPC ..... 510/230, 444, 445, 480, 499
See application file for complete search history.

(56) References Cited

U.S. PATENT DOCUMENTS

| | | | |
|---|---|---|---|
| 5,152,403 | A | 10/1992 | Patel |
| 5,770,555 | A | 6/1998 | Weinstein |
| 6,462,006 | B1 | 10/2002 | Sorg et al. |
| 8,048,838 | B2 | 11/2011 | Witteler |
| 2002/0137649 | A1 | 9/2002 | Carnali |
| 2008/0188391 | A1 | 8/2008 | Seebeck et al. |
| 2009/0075855 | A1 | 3/2009 | Gibis et al. |
| 2010/0160203 | A1 | 6/2010 | Seebeck et al. |
| 2010/0227787 | A1 | 9/2010 | Seebeck et al. |
| 2010/0249010 | A1 | 9/2010 | Seebeck et al. |
| 2011/0054215 | A1 | 3/2011 | Euser et al. |
| 2012/0004147 | A1 | 1/2012 | Seetz et al. |
| 2012/0010117 | A1 | 1/2012 | Seebeck et al. |
| 2012/0196784 | A1 | 8/2012 | Seebeck et al. |
| 2012/0252708 | A1 | 10/2012 | Van Lare |
| 2013/0209806 | A1 | 8/2013 | Van Lare |
| 2014/0073554 | A1 | 3/2014 | Van Der Eerden et al. |
| 2014/0179586 | A1 | 6/2014 | Letzelter |
| 2016/0010031 | A1 | 1/2016 | Parte |
| 2016/0010034 | A1 | 1/2016 | Pandey |

FOREIGN PATENT DOCUMENTS

| | | | |
|---|---|---|---|
| DE | 198 19 187 | A1 | 11/1999 |
| DE | 10 2005 041 349 | A1 | 3/2007 |
| DE | 10 2006 034 900 | A1 | 1/2008 |
| EP | 0 851 023 | A2 | 7/1998 |
| EP | 2 399 998 | | 12/2011 |
| EP | 2399981 | A1 | 12/2011 |
| GB | 2491619 | A | 12/2012 |
| JP | 2009-120801 | | 6/2009 |
| JP | 2009-1 49739 | | 7/2009 |
| JP | 2009149777 | A | 7/2009 |
| JP | 2013525546 | A | 6/2013 |
| JP | 2014025013 | A | 2/2014 |
| RU | 2 168 578 | C2 | 7/2000 |
| WO | WO 2009/003979 | A1 | 1/2009 |
| WO | WO 2009/103822 | A1 | 8/2009 |
| WO | WO 2010/076291 | | 7/2010 |
| WO | WO 2011/080540 | A1 | 7/2011 |
| WO | WO 2012/000914 | A1 | 1/2012 |

OTHER PUBLICATIONS

International Search Report and Written Opinion of the International Searching Authority dated May 19, 2015 in PCT/EP2015/052533 filed Feb. 6, 2015.
International Preliminary Report on Patentability dated Mar. 10, 2016 in PCT/EP2015/052533 filed Feb. 6, 2015.
Rohm and Haas—Acusol 445/445N/445N D, pp. 1-5, Jul. 2006. (Year: 2006).

*Primary Examiner* — Gregory R Delcotto
(74) *Attorney, Agent, or Firm* — ArentFox Schiff LLP

(57) ABSTRACT

The present invention is directed towards a process for making a powder or granule containing (A) at least one chelating agent selected from methyl glycine diacetic acid (MGDA) and glutamic acid diacetate (GLDA) and iminodisuccinic acid (IDS) and their respective alkali metal salts, (B) at least one homo- or copolymer of (meth)acrylic acid, partially or fully neutralized with alkali, said process comprising the steps of (a) mixing the at least one chelating agent (A) and the at least one homo- or copolymer (B) in the presence of water, (b) removing most of said water by spray-drying or spray granulation using a gas with an inlet temperature of at least 125° C.

7 Claims, No Drawings

POWDER AND GRANULE, PROCESS FOR MAKING SUCH POWDER AND GRANULE, AND USE THEREOF

CROSS-REFERENCE TO RELATED APPLICATION

The present application is a Divisional of Ser. No. 15/118,808, pending, having a filing date of Aug. 12, 2016, which is a 371 of International Application PCT/EP2015/052533, having a filing date of Feb. 6, 2015 which claims benefit of priority to European Patent Application Nos. 14154957.6, having a filing date of Feb. 13, 2014, and 14189501.1, having a filing date of Oct. 20, 2014, both of which are incorporated herein by reference in their respective entireties.

The present invention is directed towards a process for making a powder or granule containing (A) in the range of from 80 to 99% by weight of at least one chelating agent selected from methyl glycine diacetic acid (MGDA) and glutamic acid diacetate (GLDA) and iminodisuccinic acid (IDS) and their respective alkali metal salts, (B) in the range of from 1 to 20% by weight of at least one homo- or copolymer of (meth)acrylic acid, partially or fully neutralized with alkali, percentages referring to the solids content of said powder or granule, said process comprising the steps of (a) mixing the at least one chelating agent (A) and the at least one homo- or copolymer (B) in the presence of water, (b) removing most of said water by spray-drying or spray granulation using a gas with an inlet temperature of at least 125° C.

Complexing agents such as methyl glycine diacetic acid (MGDA) and glutamic acid diacetic acid (GLDA) and their respective alkali metal salts are useful sequestrants for alkaline earth metal ions such as $Ca^{2+}$ and $Mg^{2+}$. For that reason, they are recommended and used for various purposes such as laundry detergents and for automatic dishwashing (ADW) formulations, in particular for so-called phosphate-free laundry detergents and phosphate-free ADW formulations. For shipping such complexing agents, in most cases either solids such as granules or powders are being applied or aqueous solutions.

Granules and powders have the advantage of being essentially water-free. That means that in case of shipping, no water has to be shipped, and costs for extra weight can be avoided. However, still many powders and granules show the problem of yellowing, in particular when contacted with chlorine-free bleaching agents such as, but not limited to inorganic peroxides. Examples of inorganic peroxides are sodium perborate, sodium persulfate and in particular sodium percarbonate.

A lot of additives have been tried in order to limit such yellowing. Most of them, however, either deteriorate the activity of the bleaching agent or considerably slow down the dissolution of the complexing agent, both effects being undesirable.

WO 2009/103822 discloses a process for making granules of MGDA by heating a slurry of MGDA with a high solids content and spray drying such highly concentrated slurry with an air inlet temperature in the range of from 50 to 120° C.

From WO 2009/003979 it is known that the addition of polyethylene glycol to MGDA has a beneficial effect for the manufacture of tablets for automatic dishwashing. However, the yellowing problem has not been addressed.

It was therefore an objective of the present invention to provide a chelating agent preferably in form of a powder or of a granule, such powder or granule showing a reduced yellowing behaviour especially after contact with one or more chlorine-free bleaching agents. It was further an objective to provide a process for making a chelating agent preferably in form of a powder or of a granule, such powder or granule showing a reduced yellowing behaviour especially after contact with one or more chlorine-free bleaching agents.

Accordingly, the process defined at the outset has been found, hereinafter also being referred to as "inventive process" or as "process according to the (present) invention".

The inventive process provides granules or powders, hereinafter also referred to as "inventive granules" or "inventive powders", respectively. Inventive powders and inventive granules can be manufactured according to the inventive process.

In the course of the present invention, inventive powders are particulate materials that are solids at ambient temperature and that preferably have an average particle diameter in the range of from 1 μm to less than 0.1 mm, preferably 100 μm up to 750 μm. The average particle diameter of inventive powders can be determined, e.g., by LASER diffraction methods, for example with Malvern apparatus, and refers to the volume average. Inventive granules are particulate materials that are solids at ambient temperature and that preferably have an average particle diameter in the range of from 0.1 mm to 2 mm, preferably 0.75 mm to 1.25 mm. The average particle diameter of inventive granules can be determined, e.g., by optical or preferably by sieving methods. Sieves employed may have a mesh in the range of from 60 to 1,250 μm.

In one embodiment of the present invention, inventive powders or inventive granules have a broad particle diameter distribution. In another embodiment of the present invention, inventive powders or inventive granules have a narrow particle diameter distribution. The particle diameter distribution can be adjusted, if desired, by multiple sieving steps.

Granules and powders may contain residual moisture, moisture referring to water including water of crystallization and adsorbed water. The amount of water may be in the range of from 0.1 to 20% by weight, preferably 1 to 15% by weight, referring to the total solids content of the respective powder or granule, and may be determined by Karl-Fischer-titration or by drying at 160° C. to constant weight with infrared light.

Particles of inventive powders may have regular or irregular shape. Preferred shapes of particles of inventive powders are spheroidal shapes.

Particles of inventive granules may have regular or irregular shapes. Preferred shapes of particles of inventive granules are spheroidal shapes.

Powders and granules made according to the inventive process contain (A) in the range of from 80 to 99% by weight of at least one chelating agent selected from methyl glycine diacetic acid (MGDA) and glutamic acid diacetate (GLDA) and iminodisuccinic acid (IDS) and their respective alkali metal salts, MGDA and GLDA and IDS and their respective alkali metal salts altogether also being referred to as "chelating agent (A)", (B) in the range of from 1 to 20% by weight of at least one homo- or copolymer of (meth)acrylic acid, partially or fully neutralized with alkali, hereinafter also referred to as "polymer (B)". Polymers (B) that are homopolymers are also being referred to as "homopolymers (B)", and polymers (B) that are copolymers are also being referred to as "copolymers (B)".

The percentages refer to the solids content of said powder or granule.

In the context of the present invention, alkali metal salts of methylglycine diacetic acid are selected from lithium salts, potassium salts and preferably sodium salts of methylglycine diacetic acid. Methylglycine diacetic acid can be partially or preferably fully neutralized with the respective alkali. In a preferred embodiment, an average of from 2.7 to 3 COOH groups of MGDA is neutralized with alkali metal, preferably with sodium. In a particularly preferred embodiment, chelating agent (A) is the trisodium salt of MGDA.

Likewise, alkali metal salts of glutamic acid diacetic acid are selected from lithium salts, potassium salts and preferably sodium salts of glutamic acid diacetic acid. Glutamic acid diacetic acid can be partially or preferably fully neutralized with the respective alkali. In a preferred embodiment, an average of from 3.5 to 4 COOH groups of MGDA is neutralized with alkali metal, preferably with sodium. In a particularly preferred embodiment, chelating agent (A) is the tetrasodium salt of GLDA.

Likewise, alkali metal salts of iminodisuccinic acid are selected from lithium salts, potassium salts and preferably sodium salts of iminodisuccinic acid. Iminodisuccinic acid can be partially or preferably fully neutralized with the respective alkali. In a preferred embodiment, an average of from 3.5 to 4 COOH groups of IDS is neutralized with alkali metal, preferably with sodium. In a particularly preferred embodiment, chelating agent (A) is the tetrasodium salt of IDS.

MGDA and GLDA and their respective alkali metal salts are preferred.

MGDA and its respective alkali metal salts can be selected from the racemic mixtures, the D-isomers and the L-isomers, and from mixtures of the D- and L-isomers other than the racemic mixtures. Preferably, MGDA and its respective alkali metal salts are selected from the racemic mixture and from mixtures containing in the range of from 55 to 85 mole-% of the L-isomer, the balance being D-isomer. Particularly preferred are mixtures containing in the range of from 60 to 80 mole-% of the L-isomer, the balance being D-isomer.

The distribution of L- and D-enantiomer can be determined by measuring the polarization (polarimetry) or preferably by chromatography, for example by HPLC with a chiral column, for example with one or more cyclodextrins as immobilized phase. Preferred is determination of the ee by HPLC with an immobilized optically active ammonium salt such as D-penicillamine.

GLDA and its respective alkali metal salts can be selected from the racemic mixtures, the D-isomers and the L-isomers, and from mixtures of the D- and L-isomers other than the racemic mixtures. Preferably, GLDA and its respective alkali metal salts are selected from mixtures containing in the range of from 75 to 99 mole-% of the L-isomer, the balance being D-isomer. Particularly preferred are mixtures containing in the range of from 80 to 97.5 mole-% of the L-isomer, the balance being D-isomer.

Likewise, IDS and its respective alkali metal salts may be in the form of pure isomers or preferably mixtures from isomers including the meso-form.

In any way, minor amounts of chelating agent (A) may bear a cation other than alkali metal. It is thus possible that minor amounts, such as 0.01 to 5 mol-% of total chelating agent (A) bear alkali earth metal cations such as $Mg^{2+}$ or $Ca^{2+}$, or an $Fe^{2+}$ or $Fe^{3+}$ cation.

In one embodiment of the present invention, chelating agent (A) may contain one or more impurities that may result from the production of the respective chelating agent. In the case of MGDA and its alkali metal salts, such impurities may be selected from alkali metal propionate, lactic acid, alanine or the like. Such impurities are usually present in minor amounts. "Minor amounts" in this context refer to a total of 0.1 to 1% by weight, referring to chelating agent (A). In the context of the present invention, such minor amounts are neglected when determining the composition of inventive powder or inventive granule, respectively.

In one embodiment of the present invention, chelating agent that is starting material for the inventive process is of white or pale yellow appearance.

Polymer (B) is selected from homopolymers (B) of (meth) acrylic acid and of copolymers (B) of (meth)acrylic acid, preferably of acrylic acid, partially or fully neutralized with alkali. In the context of the present invention, copolymers (B) are those in which at least 50 mol-% of the comonomers are (meth)acrylic acid, preferably at least 75 mol-%, even more preferably 80 to 99 mol-%.

Suitable comonomers for copolymers (B) are ethylenically unsaturated compounds, such as styrene, isobutene, ethylene, α-olefins such as propylene, 1-butylene, 1-hexene, and ethylenically unsaturated dicarboxylic acids and their alkali metal salty and anhydrides such as but not limited to maleic acid, fumaric acid, itaconic acid disodium maleate, disodium fumarate, itaconic anhydride, and especially maleic anhydride. Further examples of suitable comonomers are $C_1$-$C_4$-alkyl esters of (meth)acrylic acid, for example methyl acrylate, methyl methacrylate, ethyl acrylate, ethyl methacrylate, n-butyl acrylate.

In one embodiment of the present invention, polymer (B) is selected from copolymers of (meth)acrylic acid and a comonomer bearing at least one sulfonic acid group per molecule.

Comonomers bearing at least one sulfonic acid group per molecule may be incorporated into polymer (B) as free acid or least partially neutralized with alkali. Particularly preferred sulfonic-acid-group-containing comonomers are 1-acrylamido-1-propanesulfonic acid, 2-acrylamido-2-propanesulfonic acid, 2-acrylamido-2-methylpropanesulfonic acid (AMPS), 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide, and salts of said acids, such as the sodium salts, potassium salts or ammonium salts thereof.

Copolymers (B) may be selected from random copolymers, alternating copolymers, block copolymers and graft copolymers, alternating copolymers and especially random copolymers being preferred.

Useful copolymers (B) are, for example, random copolymers of acrylic acid and methacrylic acid, random copolymers of acrylic acid and maleic anhydride, ternary random copolymers of acrylic acid, methacrylic acid and maleic anhydride, random or block copolymers of acrylic acid and styrene, random copolymers of acrylic acid and methyl acrylate. More preferred are homopolymers of methacrylic acid. Even more preferred are homopolymers of acrylic acid.

Polymer (B) may constitute straight-chain or branched molecules. Branching in this context will be when at least one repeating unit of such polymer (B) is not part of the main chain but forms a branch or part of a branch. Preferably, polymer (B) is not cross-linked.

In one embodiment of the present invention, polymer (B) has an average molecular weight $M_w$ in the range of from 1,200 to 30,000 g/mol, preferably from 2,500 to 15,000 g/mol and even more preferably from 3,000 to 10,000 g/mol, determined by gel permeation chromatography (GPC) and referring to the respective free acid.

In one embodiment of the present invention, polymer (B) is at least partially neutralized with alkali, for example with lithium or potassium or sodium or combinations of at least two of the forgoing, especially with sodium. For example, in the range of from 10 to 100 mol-% of the carboxyl groups of polymer (B) may be neutralized with alkali, especially with sodium.

In one embodiment of the present invention, polymer (B) is selected from per-sodium salts of polyacrylic acid, thus, polyacrylic acid, fully neutralized with sodium.

In one embodiment of the present invention, polymer (B) is selected from a combination of at least one polyacrylic acid and at least one copolymer of (meth)acrylic acid and a comonomer bearing at least one sulfonic acid group per molecule, both polymers being fully neutralized with alkali.

In one embodiment of the present invention, polymer (B) is selected from per-sodium salts of polyacrylic acid with an average molecular weight $M_w$ in the range of from 1,200 to 30,000 g/mol, preferably from 2,500 to 15,000 g/mol and even more preferably from 3,000 to 10,000 g/mol, determined by gel permeation chromatography (GPC) and referring to the respective free acid.

The inventive process comprises two steps, (a) mixing the at least one chelating agent (A) and the at least one homo- or copolymer (B) in the presence of water, (b) removing most of said water by spray-drying or spray granulation, hereinafter also referred to as step (a) and step (b). Usually, step (b) is performed after step (a).

Step (a) and step (b) will be described in more detail below.

Mixing of chelating agent (A) and polymer (B) is usually performed in the presence of water. Said mixing can be conducted in a way that an aqueous solution of polymer (B) and an aqueous solution of chelating agent (A) are being combined in a vessel, preferably under stirring. It is also possible to combine an aqueous solution of polymer (B) and solid chelating agent (A), or to combine an aqueous solution of chelating agent (A) with solid polymer (B), or to combine aqueous slurries of chelating agent (A) and polymer (B). In an alternative embodiment, water is provided and subsequently, polymer (B) and then chelating agent (A) are added. In a preferred embodiment, a solution of chelating agent (A) is provided that has a temperature of 35 to 50° C., and polymer (B) is being added, either in bulk or as solution.

Step (a) can be performed at ambient temperature. In other embodiments, step (a) is being performed at 20° C. or at elevated temperature, for example at a temperature in the range of from 25 to 90° C., preferably 60 to 75° C.

The water used in step (a) may be present in an amount that both chelating agent (A) and polymer (B) are dissolved. However, it is also possible to use less amounts of water and mix chelating agent (A) and polymer (B) in a way that a slurry is being formed. Solutions are preferred.

In one embodiment of the present invention, the total solids content of such solution or slurry formed as result of step (a) is in the range of from 20 to 75%, preferably 35 to 50%.

In one embodiment of the present invention, such solution or slurry has a pH value in the range of from 2.5 to 13, preferably from 7 to 13 and even more preferably at least 8.

Mixing may be performed with mechanical support, for example shaking or stirring.

In step (b), a spray-drying or spray granulation is performed, using a gas with an inlet temperature of at least 125° C. Said gas, hereinafter also being referred to as "hot gas", may be nitrogen, a rare gas or preferably air. In the course of step (b), most of the water used in step (a) will be removed, for example at least 55%, preferably at least 65% of the water. In one embodiment of the present invention, 99% of the water at most will be removed.

Spray-drying and spray granulation will be described in more detail below.

In one embodiment of the present invention, a drying vessel, for example a spray chamber or a spray tower, is being used in which a spray-granulating process is being performed by using a fluidized bed. Such a drying vessel is charged with a fluidized bed of a solid mixture solid mixture of chelating agent (A) and polymer (B), obtained by any drying method such as spray drying or evaporation crystallization, and a solution or slurry of solid mixture of chelating agent (A) and polymer (B) is sprayed onto or into such fluidized bed together with a hot gas stream. The hot gas inlet stream may have a temperature in the range of from 125 to 350° C., preferably 160 to 220° C.

In one embodiment of the present invention, the fluidized bed may have a temperature in the range of from 80 to 150° C., preferably 100 to 120° C.

Spraying is being performed through one or more nozzles per drying vessel. Suitable nozzles are, for example, high-pressure rotary drum atomizers, rotary atomizers, single-fluid nozzles and two-fluid nozzles, two-fluid nozzles and rotary atomizers being preferred. The first fluid is the solution or slurry obtained according to step (a), the second fluid is compressed gas, for example with a pressure of 1.1 to 7 bar.

In one embodiment of the present invention, the droplets formed during the spray-granulating have an average diameter in the range of from 10 to 500 μm, preferably from 20 to 180 μm, even more preferably from 30 to 100 μm.

In one embodiment of the present invention, the off-gas departing the drying vessel may have a temperature in the range of from 40 to 140° C., preferably 80 to 110° C. but in any way colder than the hot gas stream. Preferably, the temperature of the off-gas departing the drying vessel and the temperature of the solid product present in the drying vessel are identical.

In another embodiment of the present invention, spray-granulation is being performed by performing two or more consecutive spray-drying processes, for example in a cascade of at least two spray dryers, for example in a cascade of at least two consecutive spray towers or a combination of a spray tower and a spray chamber, said spray chamber containing a fluidized bed. In the first dryer, a spray-drying process is being performed in the way as follows.

Spray-drying may be preferred in a spray dryer, for example a spray chamber or a spray tower. A solution or slurry obtained according to step (a) with a temperature preferably higher than ambient temperature, for example in the range of from 50 to 95° C., is introduced into the spray dryer through one or more spray nozzles into a hot gas inlet stream, for example nitrogen or air, the solution or slurry being converted into droplets and the water being vaporized. The hot gas inlet stream may have a temperature in the range of from 125 to 350° C.

The second spray dryer is charged with a fluidized bed with solid from the first spray dryer and solution or slurry obtained according to the above step is sprayed onto or into the fluidized bed, together with a hot gas inlet stream. The hot gas inlet stream may have a temperature in the range of from 125 to 350° C., preferably 160 to 220° C.

In one embodiment of the present invention, especially in a process for making an inventive granule, the average residence time of chelating agent (A) and polymer (B), respectively, in step (b) is in the range of from 2 minutes to 4 hours, preferably from 30 minutes to 2 hours.

In another embodiment, especially in a process for making an inventive powder, the average residence time of chelating agent (A) and polymer (B), in step (b) is in the range of from 1 second to 1 minute, especially 2 to 20 seconds.

In one embodiment of the present invention, the pressure in the drying vessel in step (b) is normal pressure±100 mbar, preferably normal pressure±20 mbar, for example one mbar less than normal pressure.

In one embodiment of the present invention, one or more additives (C) can be added to the solution obtained according to step (a) before performing step (b), or one or more of such additives (C) can be added at any stage during step (a). Examples of useful additives (C) are, for example, titanium dioxide, sugar, silica gel and polyvinyl alcohol. Polyvinyl alcohol in the context of the present invention refers to completely or partially hydrolyzed polyvinyl acetate. In partially hydrolyzed polyvinyl acetate, at least 95 mol-%, preferably at least 96 mol-% of the acetate groups have been hydrolyzed.

In one embodiment of the present invention polyvinyl alcohol has an average molecular weight $M_w$ in the range of from 22,500 to 115,000 g/mol, for example up to 40,000 g/mol.

In one embodiment of the present invention polyvinyl alcohol has an average molecular weight $M_n$ in the range of from 2,000 to 40,000 g/mol.

Additive(s) (C) can amount to 0.1 to 5% by weight, referring to the sum of chelating agent (A) and polymer (B).

Preferably, no additive (C) is being employed in step (b).

One or more additional steps (c) may be performed at any stage of the inventive proves, preferably after step (b). It is thus possible to perform a sieving step (c) to remove lumps from the powder or granule. Also, a post-drying step (c) is possible. Air classifying can be performed during or after step (b) to remove fines.

Fines, especially those with a diameter of less than 50 μm, may deteriorate the flowing behavior of powders or granules obtained according to the inventive process. However, amorphous or preferably crystalline fines may be returned to the spray vessel(s) as seed for crystallization. Lumps may be removed and either re-dissolved in water or milled and used as seed for crystallization in the spray vessel(s).

The inventive process furnishes powders or granules containing chelating agent (A) and polymer (B) and, optionally, one or more additives (C). Such powders and granules exhibit overall advantageous properties including but not limited to an excellent yellowing behavior.

Another aspect of the present invention are powders and granules, hereinafter also being referred to as inventive powders or inventive granules, respectively, containing (A) in the range of from 80 to 99% by weight of at least one chelating agent selected from methyl glycine diacetic acid (MGDA) and glutamic acid diacetate (GLDA) and their respective alkali metal salts, (B) in the range of from 1 to 20% by weight of at least one homo- or copolymer of (meth)acrylic acid, partially or fully neutralized with alkali, in molecularly disperse form, percentages referring to the solids content of said powder or granule.

Chelating agent (A) and polymer (B) have been defined above.

In the context of the present invention, the term "in molecularly disperse form" implies that all or a vast majority, for example at least 80% of the particles of inventive powder and of inventive granules contain chelating agent (A) and polymer (B).

In one embodiment of the present invention, inventive powders are selected from powders having an average particle diameter in the range of from 1 μm to less than 0.1 mm.

In one embodiment of the present invention, inventive granules are selected from granules with an average particle diameter in the range of from 0.1 mm to 2 mm, preferably 0.75 mm to 1.25 mm.

In one embodiment of the present invention, inventive powder or inventive granule contains in the range of from 80 to 99% by weight chelating agent (A) and 1 to 20% by weight homo- or copolymer (B), percentages referring to the solids content of said powder or granule.

In a preferred embodiment of the present invention, the term "in molecularly disperse form" also implies that essentially all particles of inventive powder or inventive granule contains in the range of from 80 to 99% by weight chelating agent (A) and 1 to 20% by weight homo- or copolymer (B), percentages referring to the solids content of the respective powder or granule.

In one embodiment of the present invention, inventive powders and inventive granules are selected from those wherein polymer (B) has an average molecular weight $M_w$ in the range of from 1,200 to 30,000 g/mol, determined by gel permeation chromatography and referring to the respective free acid.

In one embodiment of the present invention, inventive powders and inventive granules are selected from those wherein chelating agent (A) is selected from the trisodium salt of MGDA and the tetrasodium salt of GLDA.

In one embodiment of the present invention, inventive powders and inventive granules are selected from those wherein said homo- and copolymer (B) are selected from the per-sodium salts of polyacrylic acid.

In one embodiment of the present invention, inventive powders and inventive granules are selected from those wherein said polymer (B) is selected from copolymers of (meth)acrylic acid and a comonomer bearing at least one sulfonic acid group per molecule. Comonomers bearing at least one sulfonic acid group per molecule may be incorporated into polymer (B) as free acid or least partially neutralized with alkali. Particularly preferred sulfonic-acid-group-containing comonomers are 1-acrylamido-1-propanesulfonic acid, 2-acrylamido-2-propanesulfonic acid, 2-acrylamido-2-methylpropanesulfonic acid (AMPS), 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)-propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide, and salts of said acids, such as the sodium salts, potassium salts or ammonium salts thereof.

In one embodiment of the present invention, inventive powders and inventive granules are selected from those wherein said polymer (B) is selected from a combination of at least one polyacrylic acid and at least one copolymer of (meth)acrylic acid and a comonomer bearing at least one sulfonic acid group per molecule, both polymers being fully neutralized with alkali.

Inventive powders and inventive granules exhibit overall advantageous properties including but not limited to an excellent yellowing behavior, especially in the presence of bleaching agents. They are therefore excellently suitable for the manufacture of cleaning agents that contain at least one bleaching agent, such cleaning agent hereinafter also being referred to as bleach. In particular inventive powders and inventive granules are suitable for the manufacture cleaning agent for fibers or hard surfaces wherein said cleaning agent contains at least one peroxy compound.

Inventive granules and especially inventive powders may easily be converted into compactates and into agglomerates.

Another aspect of the present invention is therefore the use of an inventive powder or an inventive granule according for the manufacture of a cleaning agent that contains at least one bleaching agent, and in particular for the manufacture of cleaning agent for fibers or hard surfaces, wherein said cleaning agent contains at least one peroxy compound. Another aspect of the present invention is a process for making at a cleaning agent by combining at least one inventive powder or at least one inventive granule with at least one bleaching agent, preferably at least one peroxy compound. Another aspect of the present invention is a cleaning agent, hereinafter also being referred to as inventive cleaning agent. Inventive cleaning agents contain at least one bleaching agent and at least one inventive powder or at least one inventive granule. Inventive cleaning agents show a reduced tendency for yellowing and therefore have an extended shelve-life.

Examples of suitable peroxy compounds are sodium perborate, anhydrous or for example as monohydrate or as tetrahydrate or so-called dihydrate, sodium percarbonate, anhydrous or, for example, as monohydrate, hydrogen peroxide, persulfates, organic peracids such as peroxylauric acid, peroxystearic acid, peroxy-α-naphthoic acid, 1,12-diperoxydodecanedioic acid, perbenzoic acid, peroxylauric acid, 1,9-diperoxyazelaic acid, diperoxyisophthalic acid, in each case as free acid or as alkali metal salt, in particular as sodium salt, also sulfonylperoxy acids and cationic peroxy acids.

In a preferred embodiment, peroxy compound is selected from inorganic percarbonates, persulfates and perborates. Examples of sodium percarbonates are 2 $Na_2CO_3.3H_2O_2$. Examples of sodium perborate are ($Na_2[B(OH)_2(O_2)]_2$), sometimes written as $NaBO_2 \cdot O_2.3H_2O$ instead. Most preferred peroxy compound is sodium percarbonate.

The term "cleaning agents" includes compositions for dishwashing, especially hand dishwash and automatic dishwashing and ware-washing, and compositions for hard surface cleaning such as, but not limited to compositions for bathroom cleaning, kitchen cleaning, floor cleaning, descaling of pipes, window cleaning, car cleaning including truck cleaning, furthermore, open plant cleaning, cleaning-in-place, metal cleaning, disinfectant cleaning, farm cleaning, high pressure cleaning, and in addition, laundry detergent compositions.

Such cleaning agents may be liquids, gels or preferably solids at ambient temperature, solids cleaning agents being preferred. They may be in the form of a powder or in the form of a unit dose, for example as a tablet.

In one embodiment of the present invention, inventive cleaning agents may contain in the range of from 2 to 50% by weight of inventive powder or inventive granule, in the range of from 0.5 to 15% by weight of bleach.

Percentages are based on the solids content of the respective inventive cleaning agent.

Inventive cleaning agents may contain further ingredients such as one or more surfactants that may be selected from non-ionic, zwitterionic, cationic, and anionic surfactants. Other ingredients that may be contained in inventive cleaning agents may be selected from bleach activators, bleach catalysts, corrosion inhibitors, sequestering agents, fragrances, dyestuffs, antifoams, and builders.

Particularly advantageous inventive cleaning agents may contain one or more complexing agents other than MGDA or GLDA. Advantageous detergent compositions for cleaners and advantageous laundry detergent compositions may contain one or more sequestrant (chelating agent) other than a mixture according to the present invention. Examples for sequestrants other than a mixture according to the present invention are IDS (iminodisuccinate), citrate, phosphonic acid derivatives, for example the disodium salt of hydroxyethane-1,1-diphosphonic acid ("HEDP"), and polymers with complexing groups like, for example, polyethyleneimine in which 20 to 90 mole-% of the N-atoms bear at least one $CH_2COO^-$ group, and their respective alkali metal salts, especially their sodium salts, for example IDS-$Na_4$, and trisodium citrate, and phosphates such as STPP (sodium tripolyphosphate). Due to the fact that phosphates raise environmental concerns, it is preferred that advantageous inventive cleaning agents are free from phosphate. "Free from phosphate" should be understood in the context of the present invention, as meaning that the content of phosphate and polyphosphate is in sum in the range from 10 ppm to 0.2% by weight, determined by gravimetry and referring to the respective inventive cleaning agent.

Inventive cleaning agents may contain one or more surfactant, preferably one or more non-ionic surfactant.

Preferred non-ionic surfactants are alkoxylated alcohols, di- and multiblock copolymers of ethylene oxide and propylene oxide and reaction products of sorbitan with ethylene oxide or propylene oxide, alkyl polyglycosides (APG), hydroxyalkyl mixed ethers and amine oxides.

Preferred examples of alkoxylated alcohols and alkoxylated fatty alcohols are, for example, compounds of the general formula (I)

(I)

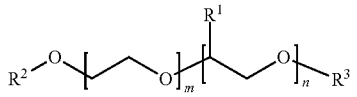

in which the variables are defined as follows:

$R^1$ is identical or different and selected from hydrogen and linear $C_1$-$C_{10}$-alkyl, preferably in each case identical and ethyl and particularly preferably hydrogen or methyl, $R^2$ is selected from $C_8$-$C_{22}$-alkyl, branched or linear, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^3$ is selected from $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, m and n are in the range from zero to 300, where the sum of n and m is at least one, preferably in the range of from 3 to 50. Preferably, m is in the range from 1 to 100 and n is in the range from 0 to 30.

In one embodiment, compounds of the general formula (I) may be block copolymers or random copolymers, preference being given to block copolymers.

Other preferred examples of alkoxylated alcohols are, for example, compounds of the general formula (II)

(II)

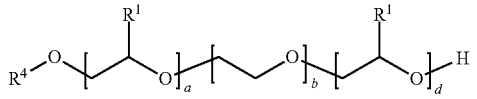

in which the variables are defined as follows:

$R^1$ is identical or different and selected from hydrogen and linear $C_1$-$C_0$-alkyl, preferably identical in each case and ethyl and particularly preferably hydrogen or methyl, $R^4$ is selected from $C_6$-$C_{20}$-alkyl, branched or linear, in particular n-$C_8H_{17}$, n-$C_{10}H_{21}$, n-$C_{12}H_{25}$, n-$C_{14}H_{29}$, n-$C_{16}H_{33}$, n-$C_{18}H_{37}$, a is a number in the range from zero to 10, preferably from 1 to 6, b is a number in the range from 1 to 80, preferably from 4 to 20, d is a number in the range from zero to 50, preferably 4 to 25.

The sum a+b+d is preferably in the range of from 5 to 100, even more preferably in the range of from 9 to 50.

Preferred examples for hydroxyalkyl mixed ethers are compounds of the general formula (III)

(III)

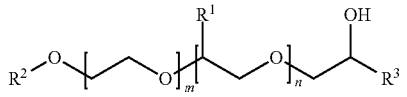

in which the variables are defined as follows:

$R^1$ is identical or different and selected from hydrogen and linear $C_1$-$C_{10}$-alkyl, preferably in each case identical and ethyl and particularly preferably hydrogen or methyl, $R^2$ is selected from $C_8$-$C_{22}$-alkyl, branched or linear, for example iso-$C_{11}H_{23}$, iso-$C_{13}H_{27}$, n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^3$ is selected from $C_1$-$C_{18}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl, isodecyl, n-dodecyl, n-tetradecyl, n-hexadecyl, and n-octadecyl.

The variables m and n are in the range from zero to 300, where the sum of n and m is at least one, preferably in the range of from 5 to 50. Preferably, m is in the range from 1 to 100 and n is in the range from 0 to 30.

Compounds of the general formula (II) and (III) may be block copolymers or random copolymers, preference being given to block copolymers.

Further suitable nonionic surfactants are selected from di- and multiblock copolymers, composed of ethylene oxide and propylene oxide. Further suitable nonionic surfactants are selected from ethoxylated or propoxylated sorbitan esters. Amine oxides or alkyl polyglycosides, especially linear $C_4$-$C_{16}$-alkyl polyglucosides and branched $C_8$-$C_{14}$-alkyl polyglycosides such as compounds of general average formula (IV) are likewise suitable.

(IV)

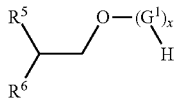

wherein the variables are defined as follows:

$R^5$ is $C_1$-$C_4$-alkyl, in particular ethyl, n-propyl or isopropyl, $R^6$ is —$(CH_2)_2$—$R^5$, $G^1$ is selected from monosaccharides with 4 to 6 carbon atoms, especially from glucose and xylose, x in the range of from 1.1 to 4, x being an average number.

An overview of suitable further nonionic surfactants can be found in EP-A 0 851 023 and in DE-A 198 19 187.

Mixtures of two or more different nonionic surfactants may also be present.

Other surfactants that may be present are selected from amphoteric (zwitterionic) surfactants and anionic surfactants and mixtures thereof.

Examples of amphoteric surfactants are those that bear a positive and a negative charge in the same molecule under use conditions. Preferred examples of amphoteric surfactants are so-called betaine-surfactants. Many examples of betaine-surfactants bear one quaternized nitrogen atom and one carboxylic acid group per molecule. A particularly preferred example of amphoteric surfactants is cocamidopropyl betaine (lauramidopropyl betaine).

Examples of amine oxide surfactants are compounds of the general formula (V)

$$R^7R^8R^9N \rightarrow O \quad (V)$$

wherein $R^7$, $R^8$ and $R^9$ are selected independently from each other from aliphatic, cycloaliphatic or $C_2$-$C_4$-alkylene $C_{10}$-$C_{20}$-alkylamido moieties. Preferably, $R^7$ is selected from $C_8$-$C_{20}$-alkyl or $C_2$-$C_4$-alkylene $C_{10}$-$C_{20}$-alkylamido and $R^8$ and $R^9$ are both methyl.

A particularly preferred example is lauryl dimethyl aminoxide, sometimes also called lauramine oxide. A further particularly preferred example is cocamidylpropyl dimethylaminoxide, sometimes also called cocamidopropylamine oxide.

Examples of suitable anionic surfactants are alkali metal and ammonium salts of $C_8$-$C_{18}$-alkyl sulfates, of $C_8$-$C_{18}$-fatty alcohol polyether sulfates, of sulfuric acid half-esters of ethoxylated $C_4$-$C_{12}$-alkylphenols (ethoxylation: 1 to 50 mol of ethylene oxide/mol), $C_{12}$-$C_{18}$ sulfo fatty acid alkyl esters, for example of $C_{12}$-$C_{18}$ sulfo fatty acid methyl esters, furthermore of $C_{12}$-$C_{18}$-alkylsulfonic acids and of $C_{10}$-$C_{18}$-alkylarylsulfonic acids. Preference is given to the alkali metal salts of the aforementioned compounds, particularly preferably the sodium salts.

Further examples for suitable anionic surfactants are soaps, for example the sodium or potassium salts of stearoic acid, oleic acid, palmitic acid, ether carboxylates, and alkylether phosphates.

Preferably, laundry detergent compositions contain at least one anionic surfactant.

In one embodiment of the present invention, inventive cleaning agents that are determined to be used as laundry detergent compositions may contain 0.1 to 60% by weight of at least one surfactant, selected from anionic surfactants, amphoteric surfactants and amine oxide surfactants.

In one embodiment of the present invention, inventive cleaning agents that are determined to be used for hard surface cleaning may contain 0.1 to 60% by weight of at least one surfactant, selected from anionic surfactants, amphoteric surfactants and amine oxide surfactants.

In a preferred embodiment, inventive cleaning agents do not contain any anionic detergent.

Inventive cleaning agents may comprise one or more bleach catalysts. Bleach catalysts can be selected from bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and also cobalt-, iron-, copper- and ruthenium-amine complexes can also be used as bleach catalysts.

Inventive cleaning agents may comprise one or more bleach activators, for example N-methylmorpholinium-acetonitrile salts ("MMA salts"), trimethylammonium acetonitrile salts, N-acylimides such as, for example, N-nonanoylsuccinimide, 1,5-diacetyl-2,2-dioxohexahydro-1,3,5-triazine ("DADHT") or nitrile quats (trimethylammonium acetonitrile salts).

Further examples of suitable bleach activators are tetraacetylethylenediamine (TAED) and tetraacetylhexylenediamine.

Inventive cleaning agents may comprise one or more corrosion inhibitors. In the present case, this is to be understood as including those compounds which inhibit the corrosion of metal. Examples of suitable corrosion inhibitors are triazoles, in particular benzotriazoles, bisbenzotriazoles, aminotriazoles, alkylaminotriazoles, also phenol derivatives such as, for example, hydroquinone, pyrocatechol, hydroxyhydroquinone, gallic acid, phloroglucinol or pyrogallol.

In one embodiment of the present invention, inventive cleaning agents comprise in total in the range from 0.1 to 1.5% by weight of corrosion inhibitor.

Inventive cleaning agents may comprise one or more builders, selected from organic and inorganic builders. Examples of suitable inorganic builders are sodium sulfate or sodium carbonate or silicates, in particular sodium disilicate and sodium metasilicate, zeolites, sheet silicates, in particular those of the formula $\alpha$—$Na_2Si_2O_5$, $\beta$—$Na_2Si_2O_5$, and $\delta$—$Na_2Si_2O_5$, also fatty acid sulfonates, $\alpha$-hydroxypropionic acid, alkali metal malonates, fatty acid sulfonates, alkyl and alkenyl disuccinates, tartaric acid diacetate, tartaric acid monoacetate, oxidized starch, and polymeric builders, for example polycarboxylates and polyaspartic acid.

Examples of organic builders are especially polymers and copolymers other than copolymer (B), or one additional copolymer (B). In one embodiment of the present invention, organic builders are selected from polycarboxylates, for example alkali metal salts of (meth)acrylic acid homopolymers or (meth)acrylic acid copolymers, partially or completely neutralized with alkali.

Suitable comonomers for (meth)are monoethylenically unsaturated dicarboxylic acids such as maleic acid, fumaric acid, maleic anhydride, itaconic acid and citraconic acid. A suitable polymer is in particular polyacrylic acid, which preferably has an average molecular weight $M_w$ in the range from 2000 to 40 000 g/mol, preferably 3,000 to 10,000 g/mol.

It is also possible to use copolymers of at least one monomer from the group consisting of monoethylenically unsaturated $C_3$-$C_{10}$-mono- or $C_4$-$C_{10}$-dicarboxylic acids or anhydrides thereof, such as maleic acid, maleic anhydride, acrylic acid, methacrylic acid, fumaric acid, itaconic acid and citraconic acid, with at least one hydrophilic or hydrophobic monomer as listed below.

Suitable hydrophobic monomers are, for example, isobutene, diisobutene, butene, pentene, hexene and styrene, olefins with 10 or more carbon atoms or mixtures thereof, such as, for example, 1-decene, 1-dodecene, 1-tetradecene, 1-hexadecene, 1-octadecene, 1-eicosene, 1-docosene, 1-tetracosene and 1-hexacosene, $C_{22}$-$\alpha$-olefin, a mixture of $C_{20}$-$C_{24}$-$\alpha$-olefins and polyisobutene having on average 12 to 100 carbon atoms per molecule.

Suitable hydrophilic monomers are monomers with sulfonate or phosphonate groups, and also nonionic monomers with hydroxyl function or alkylene oxide groups. By way of example, mention may be made of: allyl alcohol, isoprenol, methoxypolyethylene glycol (meth)acrylate, methoxypolypropylene glycol (meth)acrylate, methoxypolybutylene glycol (meth)acrylate, methoxypoly(propylene oxide-co-ethylene oxide) (meth)acrylate, ethoxypolyethylene glycol (meth)acrylate, ethoxypolypropylene glycol (meth)acrylate, ethoxypolybutylene glycol (meth)acrylate and ethoxypoly(propylene oxide-co-ethylene oxide) (meth) acrylate. Polyalkylene glycols here may comprise 3 to 50, in particular 5 to 40 and especially 10 to 30 alkylene oxide units per molecule.

Particularly preferred sulfonic-acid-group-containing monomers here are 1-acrylamido-1-propanesulfonic acid, 2-acrylamido-2-propanesulfonic acid, 2-acrylamido-2-methylpropanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide, and salts of said acids, such as sodium, potassium or ammonium salts thereof.

Particularly preferred phosphonate-group-containing monomers are vinylphosphonic acid and its salts.

Moreover, amphoteric polymers can also be used as builders.

Inventive cleaning agents may comprise, for example, in the range from in total 10 to 50% by weight, preferably up to 20% by weight, of builder.

In one embodiment of the present invention, inventive cleaning agents according to the invention may comprise one or more cobuilders.

Inventive cleaning agents may comprise one or more antifoams, selected for example from silicone oils and paraffin oils.

In one embodiment of the present invention, inventive cleaning agents comprise in total in the range from 0.05 to 0.5% by weight of antifoam.

Inventive cleaning agents may comprise one or more enzymes. Examples of enzymes are lipases, hydrolases, amylases, proteases, cellulases, esterases, pectinases, lactases and peroxidases.

In one embodiment of the present invention, inventive cleaning agents may comprise, for example, up to 5% by weight of enzyme, preference being given to 0.1 to 3% by weight. Said enzyme may be stabilized, for example with the sodium salt of at least one $C_1$-$C_3$-carboxylic acid or $C_4$-$C_{10}$-dicarboxylic acid. Preferred are formates, acetates, adipates, and succinates.

In one embodiment of the present invention, inventive cleaning agents may comprise at least one zinc salt. Zinc salts can be selected from water-soluble and water-insoluble zinc salts. In this connection, within the context of the present invention, water-insoluble is used to refer to those zinc salts which, in distilled water at 25° C., have a solubility of 0.1 g/l or less. Zinc salts which have a higher solubility in water are accordingly referred to within the context of the present invention as water-soluble zinc salts.

In one embodiment of the present invention, zinc salt is selected from zinc benzoate, zinc gluconate, zinc lactate, zinc formate, $ZnCl_2$, $ZnSO_4$, zinc acetate, zinc citrate, $Zn(NO_3)_2$, $Zn(CH_3SO_3)_2$ and zinc gallate, preferably $ZnCl_2$, $ZnSO_4$, zinc acetate, zinc citrate, $Zn(NO_3)_2$, $Zn(CH_3SO_3)_2$ and zinc gallate.

In another embodiment of the present invention, zinc salt is selected from ZnO, ZnO.aq, $Zn(OH)_2$ and $ZnCO_3$. Preference is given to ZnO.aq.

In one embodiment of the present invention, zinc salt is selected from zinc oxides with an average particle diameter (weight-average) in the range from 10 nm to 100 μm. The cation in zinc salt can be present in complexed form, for example complexed with ammonia ligands or water ligands, and in particular be present in hydrated form. To simplify the notation, within the context of the present invention, ligands are generally omitted if they are water ligands.

Depending on how the pH of mixture according to the invention is adjusted, zinc salt can change. Thus, it is for example possible to use zinc acetate or $ZnCl_2$ for preparing formulation according to the invention, but this converts at a pH of 8 or 9 in an aqueous environment to ZnO, $Zn(OH)_2$ or ZnO.aq, which can be present in non-complexed or in complexed form.

Zinc salt may be present in those inventive cleaning agents that are solid at room temperature. In such inventive cleaning agents zinc salts are preferably present in the form of particles which have for example an average diameter (number-average) in the range from 10 nm to 100 μm, preferably 100 nm to 5 μm, determined for example by X-ray scattering.

Zinc salt may be present in those inventive cleaning agents that are liquid at room temperature. In such inventive cleaning agents zinc salts are preferably present in dissolved or in solid or in colloidal form.

In one embodiment of the present invention, inventive cleaning agents comprise in total in the range from 0.05 to 0.4% by weight of zinc salt, based in each case on the solids content of the cleaning agent in question.

Here, the fraction of zinc salt is given as zinc or zinc ions. From this, it is possible to calculate the counterion fraction.

In one embodiment of the present invention, inventive cleaning agents are free from heavy metals apart from zinc compounds. Within the context of the present, this may be understood as meaning that inventive cleaning agents are free from those heavy metal compounds which do not act as bleach catalysts, in particular of compounds of iron and of bismuth. Within the context of the present invention, "free from" in connection with heavy metal compounds is to be understood as meaning that the content of heavy metal compounds which do not act as bleach catalysts is in sum in the range from 0 to 100 ppm, determined by the leach method and based on the solids content. Preferably, inventive cleaning agents has, apart from zinc, a heavy metal content below 0.05 ppm, based on the solids content of the formulation in question. The fraction of zinc is thus not included.

Within the context of the present invention, "heavy metals" are deemed to be all metals with a specific density of at least 6 g/cm$^3$ with the exception of zinc. In particular, the heavy metals are metals such as bismuth, iron, copper, lead, tin, nickel, cadmium and chromium.

Preferably, inventive cleaning agents comprise no measurable fractions of bismuth compounds, i.e. for example less than 1 ppm.

Inventive cleaning agents are excellent for cleaning hard surfaces and fibres.

The present invention is further illustrated by working examples.

General remarks: Nl: Norm liter, liters under normal conditions; Nm$^3$: norm cubic meter, cubic meter under normal conditions The molecular weight of polymers (B.1) and (B.2) were determined GPC. Said Measurements were performed at a pH value of 7.4 (phosphate buffer), stationary phase: cross-linked polyacrylate, mobile phase: water, pH value 7.4, phosphate buffer with 0.01 M $NaN_3$.

Starting materials:

(A.1): trisodium salt of methylglycine diacetic acid (MGDA-$Na_3$)

Polymer (B.1): polyacrylic acid, fully neutralized with sodium hydroxide, $M_w$: 4,000 g/mol, determined by GPC and referring to the free acid.

Polymer (B.2): polyacrylic acid, 25 mol-% neutralized with sodium hydroxide, $M_w$: 4,000 g/mol, determined by GPC and referring to the free acid.

EXAMPLE I: MANUFACTURE OF INVENTIVE GRANULES

I.1 Manufacture of Spray Solution SL.1

A vessel was charged with 6.37 kg of an aqueous solution of (A.1) (40% by weight) and 630 g of a 45% by weight aqueous solution of polymer (B.1). The solution SL.1 so obtained was stirred and then subjected to spray granulation.

I.2 Spray Granulation of Spray Solution SL.1

A cylindrical vessel with a perforated plate at the bottom, diameter of the cylinder: 148 mm, top lateral area 0.017 m$^2$, height: 40 cm, with a cone-shaped cartridge, inner lateral area of 0.00785 m$^2$, was charged with 1 kg of solid MGDA-$Na_3$ spherical particles, diameter 350 to 1,250 μm. An amount of 42 Nm$^3$/h of nitrogen with a temperature of 150° C. was blown from the bottom. A fluidized bed of MGDA-$Na_3$ particles was obtained. The above solution SL.1 was introduced by spraying 1.9 kg of SL.1 (20° C.) per hour into the fluidized from the bottom through a two-fluid nozzle, parameters: 4.5 Nm$^3$/h nitrogen, absolute pressure in the nozzle: 3.4 bar. Granules were formed, and the bed temperature, which corresponds to the surface temperature of the solids in the fluidized bed, was 100° C.

After every 30 minutes portions of solids were removed with an in-line discharge screw attached to the cylindrical vessel directly above the perforated plate. After such removal, an amount of 1 kg of granule remained in the fluidized bed. The solids removed were subjected to two sieving steps. Three fractions were obtained: coarse particles (diameter>1.25 mm), fines (diameter<0.355 mm), middle fraction (0.355 mm<diameter<1.25 mm). The coarse particles were milled using a hammer mill (Kinetatica Polymix PX-MFL 90D) at 4000 rpm (rounds per minute), 2 mm mesh. The powder so obtained was mixed with the fines and then altogether returned into the fluidized bed.

After 2 hours of spray granulating a steady state was reached. The middle fraction was collected as inventive granule Gr.1. The residual moisture of Gr.1 was determined to be 10.5 to 11.0%, referring to the total solids content of the granule.

In the above example, hot nitrogen of 150° C. can be replaced by hot air having a temperature of 150° C.

II. Manufacture of Further Spray Solutions and Spray Granulation Thereof

II.1 Manufacture of Spray Solution SL.2 and Spray Granulation

A vessel was charged with 6.685 kg of an aqueous solution of (A.1) (40% by weight) and 315 g of a 45% by weight aqueous solution of polymer (B.1). The solution SL.2 so obtained was stirred and then subjected to spray granulation.

For spray granulation, the protocol according to I.2 was followed but with spraying of SL.2 instead of SL.1. Inventive granule Gr.2 was obtained.

II.2 Manufacture of Spray Solution SL.3 and Spray Granulation

A vessel was charged with 6.055 kg of an aqueous solution of (A.1) (40% by weight) and 945 g of a 45% by weight aqueous solution of polymer (B.1). The solution SL.3 so obtained was stirred and then subjected to spray granulation.

For spray granulation, the protocol according to I.2 was followed but with spraying of SL.3 instead of SL.1. Inventive granule Gr.3 was obtained.

All inventive granules Gr.1, Gr.2, and Gr.3 contain (A.1) and polymer (B.1) in molecularly disperse form.

II.3: Comparative Example: Manufacture of a Comparative Spray Solution and Spray Granulation Thereof A vessel was charged with 7 kg of an aqueous solution of (A.1) (40% by weight) but no polymer (B.1). The solution C-SL.4 so obtained was then subjected to spray granulation.

For spray granulation, the protocol according to I.2 was followed but with spraying of C-SL.4 instead of SL.1. Inventive granule C-Gr.4 was obtained.

III. Storage Tests

An amount of 10 g of inventive granule Gr.1 or Gr.2 or Gr.3 or of comparative granule C-Gr.4 was mixed with 5 g of sodium percarbonate $2Na_2CO_3.3H_2O$ commercially available from Reckitt Benckiser. The mixture so obtained was filled into a glass container and stored under air at 35° C. and 70% humidity. 5 minutes after start of the storage test, and after each 11 days, after 18 days, and after 25, the diffuse reflection was determined as remission and measured with a spectrophotometer for determining the whiteness, manufacturer: Elrepho from Data Color SF450 aperture LAV 30, measuring b-value at a wavelength of 360-700 nm. Further parameters: average daylight D65/10°, optical geometry D0. A high the diffuse reflection corresponds with a high yellowing of the sample. The diffuse reflection values obtained are summarized in table 1.

TABLE 1

Yellowing behavior of inventive granules and of comparative granule

| Diffuse reflection after | Gr.1 | Gr.2 | Gr.3 | C-Gr.4 |
|---|---|---|---|---|
| 5 minutes | 7.5 | 8.54 | 8.82 | 6.44 |
| 11 days | n.d. | n.d. | n.d. | 10.42 |
| 18 days | 9.65 | 11.06 | 9.77 | 17.75 |
| 25 days | 15.72 | n.d. | 19.31 | 25.06 |

n.d.: not determined

The yellowing/diffuse reflection is determined as B value.

The invention claimed is:

1. A process for making a powder or granule comprising (A) in the range of from 80 to 99% by weight of methyl glycine diacetic acid (MGDA) or an alkali metal salt thereof, (B) in the range of from 1 to 20% by weight of a polymer selected from (i) polyacrylic acid, (ii) copolymers of (meth)acrylic acid and a comonomer having at least one sulfonic acid group, and (iii) salts thereof, wherein the polymer has an average molecular weight Mw in the range of from 1,200 to 30,000 g/mol, determined by gel permeation chromatography and referring to the respective free acid, percentages referring to the solids content of said powder or granule, the process comprising;

(a) mixing (A) and (B) in the presence of water thereby forming a solution; and (b) removing most of said water from the solution by spray-drying or spray granulation using a gas with an inlet temperature of at least 125° C. to form the powder or granule.

2. The process according to claim 1, wherein (B) is a per-sodium salt of polyacrylic acid.

3. The process of claim 1, wherein the water is removed from the solution by spray-drying to form the powder in which (A) and (B) are in molecularly disperse form.

4. The process of claim 3, wherein all f the particles of the powder contain both (A) and (B).

5. The process of claim 1, wherein the inlet temperature during the spray-drying or spray granulation is from 150° C. to 220° C.

6. The process of claim 1, wherein (A) is a trisodium salt of methylglycine diacetic acid, and (B) is a polyacrylic acid that is at least 25% neutralized and has a Mw of 4,000-30,000 g/mol, determined by GPC and referring to the free acid.

7. The process of claim 1, wherein the water is removed from the solution by spray granulation to form a fluidized bed of particles.

* * * * *